US006723686B2

(12) United States Patent
Calle et al.

(10) Patent No.: US 6,723,686 B2
(45) Date of Patent: Apr. 20, 2004

(54) COMPOSITIONS FOR CABLES FILLING

(75) Inventors: Juan Antonio Barrio Calle, Madrid (ES); Carlos Gonzalez Gonzalez, Madrid (ES); Juan Antonio Prieto Noguera, Algorcon (ES)

(73) Assignee: Dynasol Elastomeros S.A., Madrid (ES)

( * ) Notice: Subject to any disclaimer, the term of this patent is extended or adjusted under 35 U.S.C. 154(b) by 112 days.

(21) Appl. No.: 09/974,635

(22) Filed: Oct. 9, 2001

(65) Prior Publication Data

US 2002/0061825 A1 May 23, 2002

(30) Foreign Application Priority Data

Oct. 10, 2000 (EP) ..... 00500210

(51) Int. Cl.[7] ..... C10M 155/00; C10M 155/02; C10M 157/10

(52) U.S. Cl. ..... 508/591; 508/207; 508/384; 523/173

(58) Field of Search ..... 508/591, 207, 508/384; 523/173

(56) References Cited

U.S. PATENT DOCUMENTS

| | | | | | |
|---|---|---|---|---|---|
| 4,176,240 | A | * | 11/1979 | Sabia | 174/23 C |
| 4,259,540 | A | * | 3/1981 | Sabia | 174/23 C |
| 4,351,913 | A | * | 9/1982 | Patel | 523/218 |
| 4,464,013 | A | * | 8/1984 | Sabia | 385/109 |
| 4,497,538 | A | * | 2/1985 | Patel | 385/109 |
| 4,509,821 | A | * | 4/1985 | Stenger | 385/101 |
| 4,810,395 | A | | 3/1989 | Levy et al. | 252/28 |
| 4,852,965 | A | * | 8/1989 | Mullin et al. | 385/101 |
| 4,942,270 | A | * | 7/1990 | Gamarra | 174/93 |
| 5,149,736 | A | * | 9/1992 | Gamarra | 524/490 |
| 5,348,669 | A | | 9/1994 | Brauer et al. | 508/136 |
| 5,358,664 | A | | 10/1994 | Brauer | 252/315.4 |
| 5,844,021 | A | * | 12/1998 | Koblitz et al. | 523/173 |

FOREIGN PATENT DOCUMENTS

| | | |
|---|---|---|
| EP | 0 236 918 A2 | 9/1987 |
| EP | 0 601 953 B1 | 6/1994 |
| EP | 0 749 128 A2 | 12/1996 |
| EP | 0 885 905 A1 | 12/1998 |
| WO | 97/04465 | 2/1997 |

* cited by examiner

*Primary Examiner*—Jacqueline V. Howard
(74) *Attorney, Agent, or Firm*—Ladas & Parry

(57) ABSTRACT

The invention relates to compositions for cables filling wherein a styrene-butadiene block copolymer with radial structure is used as a gelling agent. This polymer is obtained through styrene and butadiene sequential polymerization and subsequent reaction with a coupling agent preferably of type $Cl_{4-n}MR_n$, wherein M=Sn or Si, R is an alkyl or aryl group and n is an integer from 0 to 2, and hydrogenation of the resulting polymer. This type of copolymer brings a higher stability to the final properties of the gel as compared with the linear hydrogenated synthetic rubbers usually used in the prior art.

22 Claims, No Drawings

COMPOSITIONS FOR CABLES FILLING

SUMMARY OF THE INVENTION

The present invention relates to the formulation of compositions for cables filling used in telecommunication, more specifically it relates to the use in these compositions of a hydrogenated radial styrene-butadiene block copolymer.

STATE OF THE ART

The use of synthetic rubbers in the formulation of waterproof compounds used in communication cables filling is known, the aim of these synthetic rubbers is to act as gelling agents, effective in the formation of a crystalline structure stable during long storage periods and in different temperature conditions.

On the other hand, the cables filling compositions of the prior art formulated with synthetic rubber show an excellent behavior as an anti-humidity barrier, avoiding the penetration of contaminators and protecting the cable from the breaking due to mechanical efforts during its handling. Due to their suitable viscosity, they can be injected at low temperature, filling the interstices of the cable and giving to the final product characteristics suitable as a support of the wires.

Examples of this type of formulations can be found in different patents: EP 0749128, U.S. Pat. Nos. 5,358,664, 4,810,395, 5,348,669, EP 0236918 and WO 97/04465.

The formulation of these compositions is realized by using mainly refined mineral basis or synthetic basis with the addition of synthetic rubbers (usually hidrogenated), and optionally polyethylene waxes and anti-oxidant additives.

However, these formulations show the problem that they are very sensitive to the variations of the waxes used in the formulation. Especially the Drip-Test value, that calculates the gel stability in time and at different temperatures. So, for compositions with the same proportions of synthetic rubber, a change in crystallinity in the polyethylene wax can seriously affect the stability of these compounds.

As a consequence, there is the need of a composition for cables filling that shows improved stability over the compositions of the prior art.

It has been surprinsingly found that the use of a radial hydrogenated styrene-butadiene block copolymer in the formulation of cables filling compounds not only improves the Drip-Test values, but also substantially improves the stability of the compositions.

SUMMARY OF THE INVENTION

The invention concerns compositions for cables filling wherein a hydrogenated styrene-butadiene block copolymer with radial structure is used as a gelling agent. This polymer is obtained through styrene and butadiene sequential polymerization and subsequent reaction with a coupling agent preferably of type $Cl_{4-n}MR_n$, wherein M=Sn or Si, and hydrogenation of the resulting polymer.

DETAILED DESCRIPTION OF THE INVENTION

The object of the present invention is the provision of compositions for cables filling that show an improved stability.

The composition for cables filling of the present invention is characterized by the use of a hydrogenated styrene-butadiene block copolymer with a radial structure (radial SEBS), obtained through coupling.

The composition comprises: from 70 to 90% of a mineral or synthetic oil, from 0 to 12% of a polyethylene wax, 2 to 15% of radial SEBS synthetic rubber.

The radial copolymer can be synthesized through known methods, for example by anionic polymerization catalyzed by butillithium. In this case, a polymer is prepared by sequential polymerization of a vinyl aromatic monomer (e.g. styrene) and a conjugated diene monomer (e.g. butadiene). A lithium atom ends the chain of the polymer. In this way it is possible to go on polymerizing or reacting with other compounds as in the case of a coupling agent. The coupling agents for polymer chains are known in the art, as for $CO_2$, dihaloalcanes, divinylbenzene, carbonates, chlorides, etc. The use of agents, whose functionally is higher than two, allows the formation of radial polymers. The preferred coupling agents of the invention are of type $Cl_{4-n}MR_n$, wherein M=Sn or Si, R is an alkyl or aryl group and n is an integer from 0 to 2, and the most preferred are those having a theoretic functionality equal to four and more concretely $Cl_4Si$ or $Cl_4Sn$.

The structure of the butadiene block has preferably a vinyl content sufficient so that, when hydrogenating the polymer, this continues to be soluble in the reaction medium and the resulting polymer maintains its elastomeric properties. More specifically the vinyl content is preferably higher than 25% more preferably higher than 30% and most preferably between 35 and 45% based on the polybutadiene fraction. A known method to achieve these percentages of vinyl addition is the use of polymerization polar modifiers known in the art, such as quaternary amines, ethers, etc.

The styrene content in the copolymer is preferably between 20 and 40%, more preferably between 25 and 35% of styrene.

The coupling percentage of the styrene butadiene chains is not a critical parameter, it should however be sufficient to give the properties of a radial polymer. Preferably more than 80% of the chains and more preferably more than 90% of the chains are coupled.

The polymer final molecular weight is such that the resulting composition viscosity is as low as possible in order to be easily injectable. For this reason the molecular weight of the polymer of the invention is preferably between 30,000 and 110,000 and more preferably between 60,000 and 90,000. A too low molecular weight would not give the desired properties without adding a higher quantity of polymer, thus increasing the cost of the formulation, while a too high molecular weight would lead to viscous formulations that are difficult to be injected at room temperature and would require a higher amount of energy.

The polymers hydrogenation can be done through the methods known in she art, more preferably by a homogeneous hydrogenation process, under moderate pressure and temperature conditions, that avoids breaking of the coupled polymer chains. More preferably a metallocene catalyst is used that does not require the step of separation of the catalyst from the polymer. The most preferred hydrogenation processes used in the present invention are those described in EP 0601953 and EP 0885905, though they do not limit the present invention.

Suitable oil to be used in the present invention are polybutene oils and mineral oils such as naphthenic oils and paraffinic oils, triglyceride based oils (such as castor oil), polypropylene and polypropylene glycol oils. It is also possible to use mixtures of the above oils. Preferred oils or oil compositions have a viscosity at 100° C. between 2 and 6 cSt.

The composition can also comprise up to 12% by weight of a polyethylene wax. Preferred polyethylene waxes have a melting point comprised between 90 and 120° C.

The composition can also comprise other components, such as antioxidants, dyes, fungus inhibitors.

In a preferred embodiment, the composition comprises from 0.05 to 0.4% by weight of an antioxidant.

What follows are some explanatory examples of the composition object the invention, that show the advantage of using radial SEBS as compared to linear SEBS sythetic rubbers. These examples do not imply any limitation of the scope of the invention.

EXAMPLES

Synthesis of a Radial SEBS

In a 2 liter stainless steel stirred reactor, 1200 ml of cyclohexane, 233 ml of a 18.2% by weight solution of styrene in cyclohexane and 6.4 ml of tetrahydrofurane were introduced in a $N_2$ atmosphere. They were warmed up to 70° C. and 17 ml of a 3% solution of n-butillithium in cyclohexane were added as the polymerization initiator. They were left reacting for 25 minutes to form a polystyrillithium chain, then 128 ml of butadiene were added and they were left reacting for 25 more minutes. At the end of this time 1.5 mmoles of $Cl_4Si$ were added to the reactor and it was left reacting for 5 minutes.

A sample was collected for analysis and what resulted was an SBS polymer with a styrene content of 30%, a vinyl addition in butadiene of 40% and an average molecular weight by number of 75,000. The amount of coupled chains was 92%.

The polymer was subjected to hydrogenation by using $Cp_2Ti(4\text{-}OMe\text{—}Ph)_2$, as described in EP 0601953 and EP 0885905. The hydrogenation reaction was carried out in the same vessel where polymerization was performed. The initial temperature for hydrogenation was 90° C., the hydrogen pressure was 10 kg/cm$^2$ and the total amount of hydrogenation catalyst used was 0.22 mmol/100 g polymer. The hydrogenation proceeded until the hydrogen flow fell down to zero in 30 minutes, the percentage of hydrogenation was higher than 99% of the olefinic double bounds without any hydrogenation of the styrene units. The resulting hydrogenated SBS, called SEBS, was further isolated from the reaction medium through elimination of the solvent with steam and further drying of the polymer in an oven.

Comparative Example 1

A formulation with a basis of mineral oil with linear SEBS synthetic rubber (KG 1652™ by Shell) and polyethylene wax AC-9™ by Allied (group 1, characteristics table 1) in the proportions that are shown in Table 2, shows a Drip Test value FTM-791, % by weight (70° C. 24 h)=10.5.

Comparative Example 2

A formulation is realized with a basis of mineral oil with linear SEBS synthetic rubber (Calprene-H 6110™ by Repsol Química) and polyethylene wax by Allied AC-9 (group 1) in the proportions of the compositions of Table 2, shows a Drip Test value FTM-791, % by weight (70° C. 24 h)=9.8

In examples 1 and 2 it is shown how lower Drip Test values are obtained by using coupled SEBS synthetic rubbers.

Example 1

A formulation is realized with a basis of mineral oil with a coupled SEBS synthetic rubber, Sample A1, in the proportions of the compositions of Table 2 and polyethylene wax by Allied AC-$_9$™ (group 1), has a Drip Test value FTM-791 of 2.4% by weight (70° C. 24 h).

The characteristics of Sample A1 are: content of styrene 33,0% by weight, coupled with $Cl_4Si$, approximate molecular weight 80,000 and content of 1,2 polybutadiene before hydrogenating 40% based on the butadiene fraction.

Example 2

A formulation is realized with a basis of mineral oil with a coupled SEBS synthetic rubber, Sample A2, in the proportions of the compositions of Table 2 and polyethylene wax by Allied AC-9™ (group 1), shows a Drip Test value FTM-791 of 3.8% by weight (70° C. 24 h)

The characteristics of sample 2 are: content in styrene 30.6% by weight, coupled with $Cl_4Si$, approximate medium molecual weight 83,000 and content in 1,2 polybutadiene before hydrogenating 40.6%.

Example 3

In example 3 it is shown that the final properties of the compositions of the invention do not change with the crystallinity of the waxes used, in contrast with the behavior of compositions based on a conventional linear synthetic rubber.

Compositions are realized in the proportions that are shown in Table 2, wherein while keeping the proportions steady, the polyethylene wax is changed, the main difference being crystallinity. In Table 2 it is shown how the Drip Test values of the composition with linear SEBS worsen (increase) when the polyethylene wax is changed, while the values of the compositions realized with a radial SEBS are essentially the same.

The main characteristics of the polyethylene waxes groups AC-9™ used are shown in Table 1, by measuring the difference in crystallinity both by Diffraction of X Rays (DRX) and by differential Calorimetry (DSC):

TABLE 1

| | | Group 1 | Group 2 |
|---|---|---|---|
| Crystallinity DRX (FWHM) %: | | | |
| | Peak 110 | 0.64 | 0.78 |
| | Peak 200 | 0.52 | 0.93 |
| Molecular w. (GPC)(5) | | | |
| | Mn | 3000 | 2790 |
| | Mw | 7340 | 6850 |
| | Mz | 13000 | 12700 |
| | Mw/Mn | 2.45 | 2.46 |
| Chromatography | | | |
| | C18–C70% | 48.3 | 61.2 |
| | >C70% | 51.7 | 38.8 |
| DSC | | | |
| | H1(J/g) | 176 | 153 |
| | H2(J/g) | 166 | 151 |

FWDH: Full Width Half Maximum
GPC: Gel Permeation Chromatography

TABLE 2

| | Test 1 | Test 2 | Test 3 | Test 4 |
|---|---|---|---|---|
| Composition | | | | |
| Mineral oil | 87.3 | 87.3 | 87.3 | 87.3 |
| Linear SEBS Synthetic rubber (Kraton G-1652 ™) | 4.9 | 4.9 | — | — |
| Coupled SEBS Synthetic rubber (sample A1) | — | — | 4.9 | 4.9 |
| Wax AC-9 ™ (group 1) | 5.0 | — | 5.0 | — |
| Wax AC-9 ™ (group 2) | — | 5.0 | — | 5.0 |
| Additives rest | 2.8 | 2.8 | 2.8 | 2.8 |
| Properties | | | | |
| Melting point, ° C. ASTM-D-127 | 98.4 | 98.2 | 98.8 | 97.6 |
| Viscosity at 120° C., cSt ASTM-D-445 | 27.9 | 28.6 | 29.9 | 30.2 |
| Drip-Test at 70° C./24h FTM-791 | 7.1 | 11.9 | 3.8 | 3.9 |

What is claimed is:

1. A stable composition for cable filling comprising a mineral or synthetic oil and a radial hydrogenated styrene-butadiene block copolymer.

2. A composition according to claim 1 further comprising a polyethylene wax.

3. The composition of claim 1 wherein the composition comprises 70 to 90% by weight of the mineral oil, 2 to 15% by weight of the radial hydrogenated styrene-butadiene block copolymer, and 0 to 12% by weight of polyethylene wax.

4. The composition of claim 1 wherein the radial hydrogenated styrene-butadiene block copolymer is synthesized through coupling polymer chains of styrene and butadiene with $Cl_4Si$ or $Cl_4Sn$.

5. The composition of claim 1 wherein the radial hydrogenated styrene-butadiene block copolymer comprises between 20 and 40% by weight of styrene.

6. The composition of claim 1 wherein radial hydrogenated styrene-butadiene block copolymer comprises higher than 25% by weight of vinyl.

7. The composition of claim 1 wherein the radial hydrogenated styrene-butadiene block copolymer has a molecular weight between 30,000 and 110,000.

8. A method for producing the stable composition as claimed in claim 1 comprising:

(i) sequentially polymerizing styrene and butadiene to yield polymer chains;

(ii) coupling the polymer chains with $Cl_4Si$ or $Cl_4Sn$ to obtain a radial styrene-butadiene block copolymer;

(iii) hydrogenating the radial styrene-butadiene block copolymer to obtain a radial hydrogenated styrene-butadiene block copolymer; and (iv) formulating said radial hydrogenated styrene-butadiene block copolymer with a mineral or synthetic oil to yield the stable composition claimed in claim 1.

9. The method according to claim 8 comprising further formulating said radial hydrogenated styrene-butadiene block copolymer with polyethylene wax.

10. The method according to claim 8 wherein the composition comprises 70 to 90% by weight of the mineral oil, 2 to 15% by weight of the radial hydrogenated styrene-butadiene block copolymer, and 0 to 12% by weight of polyethylene wax.

11. The method according to claim 8 wherein the radial hydrogenated styrene-butadiene block copolymer comprises between 20 and 40% by weight of styrene.

12. The method according to claim 8 wherein the radial hydrogenated styrene-butadiene block copolymer comprises higher than 25% by weight of vinyl.

13. The method according to claim 8 wherein the radial hydrogenated styrene-butadiene block copolymer has a molecular weight between 30,000 and 110,000.

14. The stable composition as claimed in claim 1 produced by a method comprising:

(i) sequentially polymerizing styrene and butadiene to yield polymer chains;

(ii) coupling the polymer chains with $Cl_4Si$ or $Cl_4Sn$ to obtain a radial styrene-butadiene block copolymer;

(iii) hydrogenating the radial styrene-butadiene block copolymer to obtain a radial hydrogenated styrene-butadiene block copolymer; and (iv) formulating said radial hydrogenated styrene-butadiene block copolymer with a mineral or synthetic oil to yield the stable composition claimed in claim 1.

15. A method of filling a cable comprising introducing into the cable the stable composition as claimed in claim 1.

16. A method of filling a cable comprising introducing into the cable the stable composition as claimed in claim 2.

17. A method of filling a cable comprising introducing into the cable the stable composition as claimed in claim 3.

18. A method of filling a cable comprising introducing into the cable the stable composition as claimed in claim 4.

19. A method of filling a cable comprising introducing into the cable the stable composition as claimed in claim 5.

20. A method of filling a cable comprising introducing into the cable the stable composition as claimed in claim 6.

21. A method of filling a cable comprising introducing into the cable the stable composition as claimed in claim 7.

22. A method of filling a cable comprising introducing into the cable the stable composition as claimed in claim 14.

* * * * *